US009222431B2

(12) United States Patent
Rösel et al.

(10) Patent No.: US 9,222,431 B2
(45) Date of Patent: Dec. 29, 2015

(54) ESTIMATING A FUEL LEAKAGE QUANTITY OF AN INJECTION VALVE DURING A SHUT-DOWN TIME OF A MOTOR VEHICLE

(75) Inventors: Gerd Rösel, Regensburg (DE); Erwin Achleitner, Obertraubling (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 253 days.

(21) Appl. No.: 13/990,577

(22) PCT Filed: Nov. 29, 2011

(86) PCT No.: PCT/EP2011/071234

§ 371 (c)(1),
(2), (4) Date: May 30, 2013

(87) PCT Pub. No.: WO2012/072607

PCT Pub. Date: Jun. 7, 2012

(65) Prior Publication Data

US 2013/0253804 A1 Sep. 26, 2013

(30) Foreign Application Priority Data

Nov. 30, 2010 (DE) ..... 10 2010 062 226

(51) Int. Cl.
*F02D 41/30* (2006.01)
*F02D 41/06* (2006.01)
(Continued)

(52) U.S. Cl.
CPC ..... *F02D 41/3005* (2013.01); *F02D 41/06* (2013.01); *F02M 65/006* (2013.01); *F02D 41/047* (2013.01); *F02D 2041/225* (2013.01); *F02D 2200/1012* (2013.01)

(58) Field of Classification Search
CPC . F02D 41/221; F02D 41/061; F02D 41/3005; F02M 65/006
USPC ..... 701/104, 103, 102, 101; 123/486, 491, 123/179.3, 179.16; 73/114.45, 114.52
See application file for complete search history.

(56) References Cited

U.S. PATENT DOCUMENTS 5,404,750 A 4/1995 Denz ..... 73/114.45
5,469,827 A 11/1995 Tomisawa ..... 123/491
(Continued)

FOREIGN PATENT DOCUMENTS

CN 101457711 A 6/2009 ..... F02M 21/02
DE 4243178 A1 6/1994 ..... F02B 77/08
(Continued)

OTHER PUBLICATIONS

JP 2005188419 (Tetsuno et al.) Jul. 14, 2005 (Machine Translation) [online] [retrieved on Jul. 6, 2015]. Retrieved from Espacenet.*
(Continued)

*Primary Examiner* — Mahmoud Gimie
(74) *Attorney, Agent, or Firm* — Slayden Grubert Beard PLLC

(57) ABSTRACT

A method is disclosed for estimating a fuel leakage quantity which enters from a leaking injection valve during a shut-down time of a motor vehicle into an intake tract or into a cylinder of an internal combustion engine of the motor vehicle and is added to a fuel mixture to be combusted during a starting process. The method may include: measuring a first start index characteristic of a starting behavior of the engine during a first starting process; determining a first injected fuel quantity during the first starting process; measuring a second start index characteristic of a starting behavior of the engine during a second starting process; determining a second injected fuel quantity during the second starting process; and estimating the fuel leakage quantity based on the measured first start index, the determined first injected fuel quantity, the measured second start index and the determined second injected fuel quantity.

16 Claims, 2 Drawing Sheets

(51) Int. Cl.

| | |
|---|---|
| ***F02M 65/00*** | (2006.01) |
| *F02D 41/04* | (2006.01) |
| *F02D 41/22* | (2006.01) |

(56) References Cited

U.S. PATENT DOCUMENTS

| | | | | |
|---|---|---|---|---|
| 6,382,188 | B2 | 5/2002 | Hasegawa et al. | 123/491 |
| 7,805,985 | B2 | 10/2010 | Friedl et al. | 73/114.45 |
| 2001/0008134 | A1* | 7/2001 | Hasegawa et al. | 123/491 |
| 2013/0253804 | A1 | 9/2013 | Rösel et al. | 701/104 |

FOREIGN PATENT DOCUMENTS

| | | | | | |
|---|---|---|---|---|---|
| DE | 19854492 | A1 | | 6/1999 | F02D 41/04 |
| DE | 102007021594 | A1 | | 11/2008 | F01D 41/22 |
| DE | 10115969 | B4 | | 4/2010 | F02D 41/06 |
| EP | 0709563 | A1 | | 5/1996 | F02D 41/04 |
| EP | 0785358 | A2 | | 7/1997 | F02B 77/08 |
| EP | 0969195 | A3 | | 5/2002 | F02D 41/04 |
| JP | 63195356 | A | | 8/1988 | F02D 41/00 |
| JP | 2005188419 | A | * | 7/2005 | F02D 41/06 |
| JP | 2008309117 | A | * | 12/2008 | |
| WO | 2012/072607 | A1 | | 6/2012 | F02D 41/06 |

OTHER PUBLICATIONS

International Search Report and Written Opinion, Application No. PCT/EP2011/071234, 20 pages, Mar. 16, 2012.

Chinese Office Action, Application No. 201180057607.8, 9 pages, Feb. 28, 2015.

* cited by examiner

ESTIMATING A FUEL LEAKAGE QUANTITY OF AN INJECTION VALVE DURING A SHUT-DOWN TIME OF A MOTOR VEHICLE

CROSS-REFERENCE TO RELATED APPLICATIONS

This application is a U.S. National Stage Application of International Application No. PCT/EP2011/071234 filed Nov. 29, 2011, which designates the United States of America, and claims priority to DE Application No. 10 2010 062 226.5 filed Nov. 30, 2010, the contents of which are hereby incorporated by reference in their entirety.

TECHNICAL FIELD

The present disclosure relates to a method for estimating a leakage fuel quantity which penetrates an intake section or a cylinder of an internal combustion engine of a motor vehicle from a leaking injection valve during a shut-down time of the motor vehicle, and during a starting process is added to a fuel mixture to be burnt. The present disclosure also relates to a corresponding device for estimating a leakage fuel quantity and to a computer program for controlling the abovementioned method. Furthermore, the present disclosure relates to a method for determining a fuel quantity which is to be injected by means of a leaking injection valve in the course of a starting process of an internal combustion engine of a motor vehicle.

BACKGROUND

In the case of what are referred to as multi-point injection (MPI) engines with one or more injection valves per cylinder or else in the case of direct injection engines, an increase in the leakage of the injection valves may occur due to soiling of the injection valves, due to a production tolerance and/or due to wear in the region of the sealing seat of the injection valves. Soiling of the injection valves can occur, for example, as a result of operation with low-additive fuels (too few cleaning additives in the fuel) over a relatively long period of time. The resulting deposits on the sealing seat can lead to a reduction in the through-flow quantity and to an increase in the leakage of the injection valves.

Reducing the through-flow of the injection valves is typically detected by a lambda controller and compensated. However, a leakage of fuel in the shut-down state of the engine or of the internal combustion engine causes fuel to be present in the intake manifold (or in the cylinder) in the form of gaseous fuel vapor or liquid fuel.

In the case of a starting process of an internal combustion engine, an engine controller measures the fuel quantity which is necessary for starting the engine in a manner which is as low in friction, and therefore smooth, as possible, as a function of various characteristic variables such as the air quantity, engine temperature, ambient temperature, etc. In this context, over-enrichment of the fuel/air mixture can be caused by an increased injection valve leakage during the starting process. Depending on the degree of leakage, this over-enrichment can go as far as giving rise to a fuel/air mixture which cannot be ignited. This in turn causes a significantly delayed start by virtue of the fact that, depending on the parameters of the engine swept volume and intake manifold volume, a specific number of engine revolutions is required until the engine actually starts. Apart from a resulting worsening of the emissions of pollutants, the driver therefore also experiences a significant loss of comfort, in particular in the case of a relatively long shut-down time.

In order to improve, inter alia, the starting behavior of an internal combustion engine, methods for adapting the fuel quality are known which evaluate, for example, the rotational speed gradient (=change in the engine rotational speed over time) when the engine starts. These methods bring about a correction in the fuel quantity or fuel mass to be injected for the entire starting process of the engine with the objective of adapting the fuel quantity or fuel mass which is present in a gaseous form in the cylinder of the engine, in order in all cases to obtain a mixture which can be ignited and to set a predefined revving up of the rotational speed until the idling rotational speed is reached. In this context, depending on the fuel quality, global corrections with an increasing or reducing effect are possible for the starting process. Methods for adapting the fuel quality are applied as a matter of priority after tank detection and when the engine is warm. An injection valve leak which may, under certain circumstances, be present causes, if it is at all detected by the adaptation, an incorrect correction value of the adaptation of the fuel quality.

SUMMARY

One embodiment provides a method for estimating a leakage fuel quantity which penetrates an intake section or a cylinder of an internal combustion engine of a motor vehicle from a leaking injection valve during a shut-down time of the motor vehicle, and during a starting process is added to a fuel mixture to be burnt, the method comprising: measuring a first start index which is characteristic of a starting behavior of the internal combustion engine during a first starting process, determining a first injected fuel quantity during the first starting process, measuring a second start index which is characteristic of a starting behavior of the internal combustion engine during a second starting process, determining a second injected fuel quantity during the second starting process, and estimating the leakage fuel quantity based on the measured first start index, the determined first injected fuel quantity, the measured second start index and the determined second injected fuel quantity.

In a further embodiment, the estimation of the leakage fuel quantity comprises setting up an equation system with at least two equations, wherein a first equation relates to the first starting process and is selected such that it shows a linear relationship between the first start index and the leakage fuel quantity to be estimated, and a second equation relates to the second starting process and is selected such that it shows a linear relationship between the second start index and the leakage fuel quantity to be estimated, wherein a proportionality factor in the two equations has the same value, and wherein a constant in the two equations has the same value, and solving the equation system, wherein the proportionality factor and/or the constant are determined from a previously known characteristic diagram of an engine controller for the internal combustion engine.

In a further embodiment, at least one nominal basic profile of the leakage fuel quantity is stored in the characteristic diagram of the engine controller as a function of the shut-down time of the motor vehicle, and wherein the nominal basic profile is taken into account in the estimation of the leakage fuel quantity.

In a further embodiment, the first equation also shows a higher-order relationship between the first start index and the leakage fuel quantity to be estimated, and the second equation also shows a higher-order relationship between the second start index and the leakage fuel quantity to be estimated.

In a further embodiment, the respective start index is a function of the ratio between an actual time period for the respective starting process and a predetermined setpoint time period for the respective starting process, or the respective start index is a function of the ratio between an actual rotational speed gradient for the respective starting process and a predetermined setpoint rotational speed gradient for the respective starting process.

In a further embodiment, the method is carried out for various operating conditions and/or ambient conditions of the motor vehicle, and the corresponding values for the leakage fuel quantity are stored, together with parameters which describe the various operating conditions and/or ambient conditions, in a characteristic diagram within a memory of an engine controller for the internal combustion engine.

In a further embodiment, the method further comprises determining whether a leakage fuel quantity from a leaking injection valve is present, wherein the method is carried out only when the leakage fuel quantity exceeds a predetermined leakage threshold value.

Another embodiment provides a method for determining a fuel quantity which is to be injected by means of a leaking injection valve in the course of a starting process of an internal combustion engine of a motor vehicle, the method comprising: determining a total fuel quantity which is suitable for optimum starting of the internal combustion engine, estimating a leakage fuel quantity by means of any of the methods discussed above, and determining the fuel quantity to be injected from the difference between the total fuel quantity and the leakage fuel quantity.

In a further embodiment, the method further comprises calculating the proportion of the total fuel quantity constituted by the leakage fuel quantity, and if this proportion exceeds a predefined threshold value, cleaning the injection valve.

Another embodiment provides a device for estimating a leakage fuel quantity which penetrates an intake section or a cylinder of an internal combustion engine of a motor vehicle from a leaking injection valve during a shut-down time of the motor vehicle, and during a starting process is added to a fuel mixture to be burnt, the device comprising: a measuring device for measuring a first start index which is characteristic of a starting behavior of the internal combustion engine during a first starting process, and for measuring a second start index which is characteristic of a starting behavior of the internal combustion engine during a second starting process; a device for determining a first injected fuel quantity during the first starting process and for determining a second injected fuel quantity during the second starting process; and a data-processing device for estimating the leakage fuel quantity based on the measured first start index, the determined first injected fuel quantity, the measured second start index and the determined second injected fuel quantity.

Another embodiment provides a computer program for estimating a leakage fuel quantity which penetrates an intake section or a cylinder of an internal combustion engine of a motor vehicle from a leaking injection valve during a shut-down time of the motor vehicle, and during a starting process is added to a fuel mixture to be burnt, wherein the computer program, when executed by a processor, is configured to carry out any of the methods disclosed above.

BRIEF DESCRIPTION OF THE DRAWINGS

Exemplary embodiments will be explained in more detail below based on the schematic drawings, wherein.

DETAILED DESCRIPTION

Figure 1:
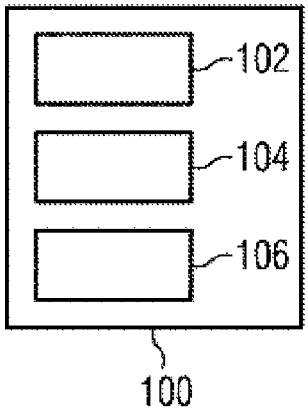
FIG. 1 shows a device for estimating a leakage fuel quantity.

Some embodiments of the present disclosure provide a method for estimating a leakage fuel quantity which penetrates an intake section or a cylinder of an internal combustion engine of a motor vehicle from a leaking injection valve during a shut-down time of the motor vehicle, and during a starting process is added to a fuel mixture to be burnt. A further object on which the present disclosure is based is to compensate the effect of an injection valve leakage in the course of a starting process.

For example, some embodiments provide a method for estimating a leakage fuel quantity which penetrates an intake section or a cylinder of an internal combustion engine of a motor vehicle from a leaking injection valve during a shut-down time of the motor vehicle, and during a starting process is added to a fuel mixture to be burnt. The described method comprises (a) measuring a first start index which is characteristic of a starting behavior of the internal combustion engine during a first starting process, (b) determining a first injected fuel quantity during the first starting process, (c) measuring a second start index which is characteristic of a starting behavior of the internal combustion engine during a second starting process, (d) determining a second injected fuel quantity during the second starting process, and (e) estimating the leakage fuel quantity based on the measured first start index, the determined first injected fuel quantity, the measured second start index and the determined second injected fuel quantity.

The described estimation method for leakage fuel quantities is based on the realization that, by evaluating two starting processes of the motor vehicle which are typically caused by a starter, the leakage fuel quantity which is fed to the combustion process via the intake section, and which therefore makes the fuel/air mixture to be burnt richer, can be at least approximately determined.

According to one example embodiment, the estimation of the leakage fuel quantity comprises setting up an equation system with at least two equations. In this context, a first equation relates to the first starting process and is selected such that it shows a linear relationship between the first start index and the leakage fuel quantity to be estimated. In addition, a second equation relates to the second starting process and is selected such that it shows a linear relationship between the second start index and the leakage fuel quantity to be estimated. In this context, a proportionality factor in the two equations has the same value, and a constant in the two equations has the same value. In the case of solving the equation system, the proportionality factor and/or the constant are determined from a previously known characteristic diagram of an engine controller for the internal combustion engine.

This can mean that, with the two equations, two unknown variables can be at least approximately determined. The first variable which is to be at least approximately determined is the searched-for leakage fuel quantity. The second variable which is to be determined is either the proportionality factor or the constant, depending on which variable is stored as a parameter in the previously known characteristic diagram of the engine controller.

It is to be noted that in the characteristic diagram both the proportionality factor and the constant can also be stored. In this case, the equation system which has the two equations is over-determined. The leakage fuel quantity to be estimated can then be determined with a particularly high level of accuracy, if appropriate by means of average value formation.

The fuel quantity which is respectively injected may also be taken into account in the linear equations in such a way that it is multiplied by the same proportionality factor. This means that for the two equations in each case the sum of (a) the leakage fuel quantity to be estimated and (b) the respectively determined, actually injected fuel quantity is multiplied by the specified proportionality factor.

In order to solve the described equation system, either analytical or regression methods can be used depending on the respective accuracy requirements and/or the available computer capacity.

According to a further example embodiment, at least one nominal basic profile of the leakage fuel quantity is stored in the characteristic diagram of the engine controller as a function of the shut-down time of the motor vehicle. In addition, the nominal basic profile is taken into account in the estimation of the leakage fuel quantity.

The specified nominal basic profile can be merely a relative profile of the leakage fuel quantity which, given a shut-down time of 0 (the internal combustion engine is started again immediately after a stationary state), extends from 0% to 100% (in the case of an, in principle, infinitely long shut-down time).

The nominal basic profile can be stored in the form of a continuous function (for example a polynomial) or in the form of discrete values, which are respectively assigned to a specific shut-down time, in the characteristic diagram. The nominal basic profile may correspond to the time profile of the leakage fuel quantity such as occurs in the case of specific ambient and/or operating conditions (a specific engine temperature when the motor vehicle is shut down, a specific external temperature, etc.). Starting from this nominal basic profile, the leakage fuel quantity for the respective operating and/or shut-down conditions is then estimated taking into account the measured first start index, the determined first injected fuel quantity, the measured second start index and the determined second injected fuel quantity.

It is to be noted that the injection valve leakage is typically strongly time-dependent and depends, in particular, on the temperature (or the viscosity) of the fuel and a differential pressure at a sealing seat of the injection valve. During the first hours of the shutting down of a vehicle, the leakage fuel quantity typically rises approximately linearly until the fuel temperature is equal to the ambient temperature and a differential pressure at the sealing seat has been eliminated. In order to achieve optimum combustion with low emission values, the injection quantity which has to be injected by the injection valves should then be reduced by that fuel quantity which has been introduced into the fuel/air mixture by the injection valve leakage.

According to a further example embodiment, the first equation also shows a higher-order relationship between the first start index and the leakage fuel quantity to be estimated, and the second equation also shows a higher-order relationship between the second start index and the leakage fuel quantity to be estimated. The higher-order relationship may be, for example, a quadratic term, with the result that the two equations represent a second-order polynomial.

Taking into account relatively high orders has the advantage that the leakage fuel quantity can be estimated with a relatively high level of accuracy.

It is to be noted that, when at least one higher order is taken into account, the equation system typically additionally has free parameters which, for example, can also be obtained from the previously known characteristic diagram of an engine controller. Alternatively or in combination (for example in order to implement an over-determined equation system), a corresponding third equation can be produced which relates to a third starting process. When the third starting process is carried out, the corresponding third start index is then also measured, and the corresponding third injected fuel quantity is determined. In addition, the values of the free parameters of the third equation are equal to those of the first and of the second equation.

According to a further example embodiment, the respective start index is a function of the ratio between an actual time period for the respective starting process and a predetermined setpoint time period for the respective starting process. Alternatively, the respective start index is a function of the ratio between an actual rotational speed gradient for the respective starting process and a predetermined setpoint rotational speed gradient for the respective starting process.

The described function of the respective ratio or of the respective quotient may be, for example, a linear function or a higher-order polynomial. The function can also be equal to "1", with the result that the respective start index is easily obtained from the specified ratio or quotient. In this case, the start index is "1" if the actual value is equal to the setpoint value.

The specified time periods may be, in particular, a time period from the beginning to the end of a starting process which is brought about by a starter. The beginning may be, for example, that time at which the starter begins to rotate the crank shaft of the internal combustion engine. The end time may be, for example, that time at which the internal combustion engine has reached a specific rotational speed.

According to a further example embodiment, the method is carried out for various operating conditions and/or ambient conditions of the motor vehicle, and the corresponding values for the leakage fuel quantity are stored, together with parameters which describe the various operating conditions and/or ambient conditions, in a characteristic diagram within a memory of an engine controller for the internal combustion engine. This makes it possible to store the respective leakage fuel quantities for various operating conditions or ambient conditions and, when necessary, to take into account the respective leakage fuel quantities in the measurement of the fuel quantities to be injected, if, at a later time, the same or at least similar operating conditions or ambient conditions are present.

According to a further example embodiment, the method also comprises determining whether a leakage fuel quantity from a leaking injection valve is present. The method is carried out only when the leakage fuel quantity exceeds a predetermined leakage threshold value.

The presence of a certain minimum leakage fuel quantity can be detected, for example, via the following starting behavior of the internal combustion engine: after the beginning of the activation of a starter ("starter turning" state), the internal combustion engine turns but, for a specific number of rotations (number of cycles), it does not go above the starting rotational speed predefined by the starter. After a defined air mass has been sucked out of the intake manifold, the internal combustion engine then starts with a delay, goes above the starting rotational speed predefined by the starter and reaches a predefined idling rotational speed. In this context, the specified number of rotations (number of cycles) and the specified air mass can be dependent on the swept volume and/or on the intake manifold volume.

It is to be noted that, in the case of an internal combustion engine with a plurality of cylinders, this starting behavior, which is due to an initial over-enrichment of the fuel/air mixture owing to a leakage fuel quantity from a leaking injection valve, can also be assigned to a plurality of cylinders.

When such a delayed starting behavior of the internal combustion engine is observed, the fuel quantity to be injected can then be reduced in the case of subsequent starting in such a way that a mixture which can be ignited ($0.8<\lambda<1.3$) is present in all cases right at the beginning of the next starting process.

It is also to be noted that an injection valve leakage can also be determined by a known algorithm for adapting the fuel quality. In this context, for example the ignition capability and/or the volatility of the fuel/air mixture can be evaluated by means of the motor effect. An injection valve leakage can therefore also be detected as a result of the reduced motor effect of an over-enriched mixture.

Other embodiments provide a method for determining a fuel quantity which is to be injected by means of a leaking injection valve in the course of a starting process of an internal combustion engine of a motor vehicle is described. The described method comprises (a) determining a total fuel quantity which is suitable for optimum starting of the internal combustion engine, (b) estimating a leakage fuel quantity by means of an abovementioned estimation method, and (c) determining the fuel quantity to be injected from the difference between the total fuel quantity and the leakage fuel quantity.

The described method for determining a fuel quantity to be injected within the scope of a starting process is based on the realization that, when a significant proportion of a fuel/air mixture fed to the cylinder or cylinders of the internal combustion engine is constituted by a leakage fuel quantity, the proportion of fuel which has to be regularly fed in via the injection valves can be correspondingly reduced. In this way, undesired over-enrichment of the fuel/air mixture, which is used for a starting process of the internal combustion engine, in particular after a relatively long shut-down time of the internal combustion engine, can be reliably avoided. As a result, the starting behavior of the internal combustion engine can be significantly improved and, in addition, undesired and increased emissions during the starting process of the internal combustion engine can be reduced.

On the other hand, if the described method is applied it is also possible to operate injection valves with a relatively high leakage level in a way which is optimized in terms of starting emissions and starting time. As a result, the service life of the injection valves can be prolonged under operating conditions and/or ambient conditions which are unfavorable for leakage. Furthermore, when injection valves are manufactured, injection valves which are also subject to a comparatively high level of leakage do not have to be rejected as unusable, which correspondingly increases the production yield.

According to one example embodiment, the method also comprises (a) calculating the proportion of the total fuel quantity constituted by the leakage fuel quantity, and (b) if this proportion exceeds a predefined threshold value, cleaning the injection valve.

The proportion of the leakage fuel quantity can be calculated here in various ways. For example, the ratio between the leakage fuel quantity and the fuel quantity to be injected can be easily calculated. Calculation of the proportion of the total fuel quantity constituted by the fuel quantity to be injected is also possible, wherein in the latter case the cleaning procedure is started if this proportion undershoots a predefined threshold value.

The cleaning of the injection valve, or in the case of a plurality of injection valves the cleaning of all the injection valves, can take place, for example, by means of an additive to the fuel during a service for cleaning the injection valve or valves.

Other embodiments provide a device for estimating a leakage fuel quantity which penetrates an intake section or a cylinder of an internal combustion engine of a motor vehicle from a leaking injection valve during a shut-down time of the motor vehicle, and during a starting process is added to a fuel mixture to be burnt. The described device comprises (a) a measuring device for measuring a first start index which is characteristic of a starting behavior of the internal combustion engine during a first starting process, and for measuring a second start index which is characteristic of a starting behavior of the internal combustion engine during a second starting process, (b) a device for determining a first injected fuel quantity during the first starting process and for determining a second injected fuel quantity during the second starting process, and (c) a data-processing device for estimating the leakage fuel quantity based on the measured first start index, the determined first injected fuel quantity, the measured second start index and the determined second injected fuel quantity.

The described device is also based on the realization that, by evaluating two starting processes of the motor vehicle which are typically caused by a starter, the leakage fuel quantity which is fed to the combustion process via the intake section can be at least approximately determined.

The described device can be implemented, for example, by a microprocessor which may be part of an engine controller for the internal combustion engine.

Other embodiments provide a computer program for estimating a leakage fuel quantity which penetrates an intake section or a cylinder of an internal combustion engine of a motor vehicle from a leaking injection valve during a shut-down time of the motor vehicle, and during a starting process is added to a fuel mixture to be burnt. The computer program, when executed by a processor, is configured to carry out the method described above for estimating a leakage fuel quantity.

According to this document, the designation of such a computer program is synonymous with the term of a program element, of a computer program product and/or of a computer-readable medium which contains instructions for controlling a computer system in order to coordinate the method of working a system or a method in a suitable way, in order to achieve the effects which are linked to the disclosed method.

The computer program can be implemented as a computer-readable instruction code in any suitable programming language, such as, for example, in JAVA, C++, etc. The computer program can be stored on a computer-readable storage medium (CD Rom, DVD, Blue ray disk, removable disk, volatile or non-volatile memory, built-in memory/processor, etc.). The instruction code can program a computer or other programmable devices such as, in particular, a control device for an internal combustion engine or an engine of a motor vehicle in such a way that the desired functions are executed. In addition, the computer program can be made available in a network such as, for example, the Internet, from which it can be downloaded by a user when necessary.

Embodiments of the present invention can be implemented by means of a computer program, i.e. software, as well as by means of one or more special electrical circuits, i.e. using hardware or in any desired hybrid form, i.e. by means of software components and hardware components.

It is to be noted that various embodiments are described with reference to different inventive subject matters. In particular, a number of embodiments are described with device claims and other embodiments are described with method claims. However, on reading this application, a person skilled in the art will understand immediately that, unless explicitly stated otherwise, as well as a combination of features which are associated with a type of inventive subject matter, any desired combination of features which are associated with different types of inventive subject matters is also possible.

FIG. 1 shows a device 100 for estimating a leakage fuel quantity which penetrates an intake section or a cylinder of an internal combustion engine of a motor vehicle from a leaking injection valve during a shut-down time of the motor vehicle, and during a starting process is added to a fuel mixture to be burnt. The estimation device 100 can be integrated, in particular, into an engine controller of a motor vehicle.

The estimation device 100 has a measuring device 102 which is configured (i) for measuring a first start index which is characteristic of a starting behavior of the internal combustion engine during a first starting process, and (ii) for measuring a second start index which is characteristic of a starting behavior of the internal combustion engine during a second starting process. The measuring device 102 can for this purpose be coupled to suitable sensors (not illustrated) for determining the respective start index. Alternatively or in combination, the measuring device 102 can also access at least a number of control variables which are processed in the engine controller.

The estimation device 100 also has a device 104 (i) for determining a first injected fuel quantity during the first starting process and (ii) for determining a second injected fuel quantity during the second starting process.

Furthermore, the estimation device 100 comprises a data-processing device 106 for estimating the leakage fuel quantity based on the measured first start index, the determined first injected fuel quantity, the measured second start index and the determined second injected fuel quantity. One way of determining the leakage fuel quantity by means of an equation system with two equations is explained in more detail below.

Figure 2:
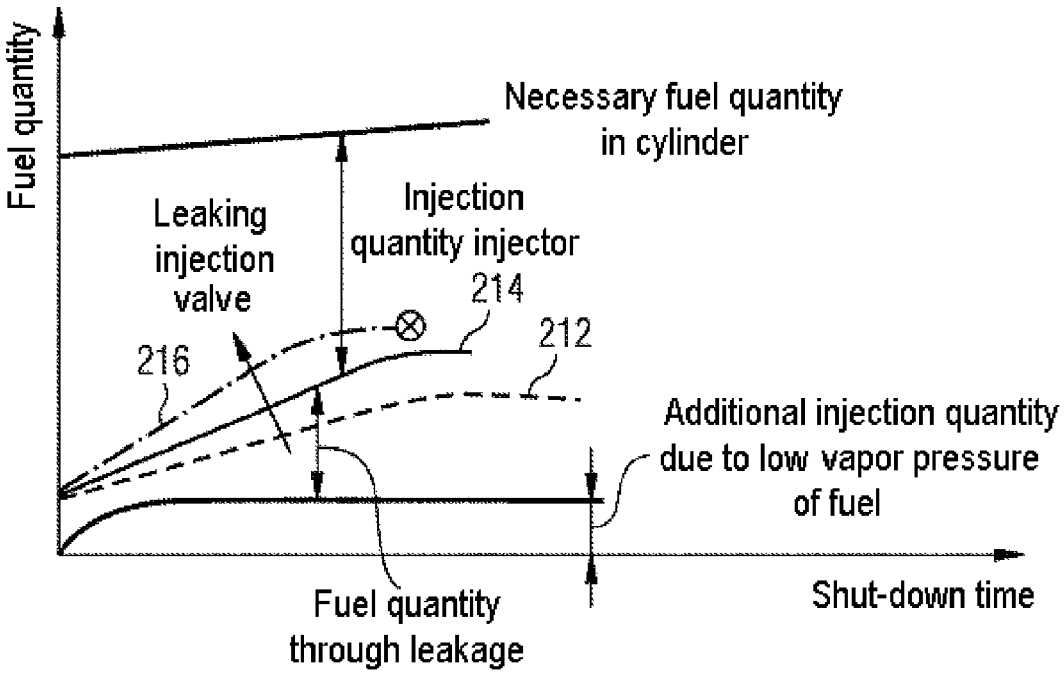
FIG. 2 shows a diagram which illustrates, as a function of the shut-down time of a motor vehicle, the ratio between (a) the fuel quantity fed in regularly via an injection valve or valves and (b) the fuel quantity introduced by means of an injection valve leakage, for various injection valve leakage rates.

FIG. 2 shows a diagram which illustrates, as a function of the shut-down time of a motor vehicle, the ratio between (a) the fuel quantity regularly fed in via an injection valve or valves and (b) the fuel quantity introduced by means of an injection valve leakage, for various injection valve leakage rates.

The upper line which, in a good approximation, runs straight and slightly obliquely shows the fuel quantity necessary for a smooth starting process in the cylinder of an internal combustion engine as a function of the shut-down time. Owing to cooling of the internal combustion engine, the fuel mixture which is to be fed to the internal combustion engine should become richer for a smooth starting process with an increasing shut-down period. The necessary fuel quantity therefore rises slightly with the shut-down time.

The lower line which is also straight in a good approximation after a brief rise illustrates an effective additional injection quantity which results from a low vapor pressure of the fuel. This additional injection quantity increases as the vapor pressure increases, and therefore as a function of the temperature.

The two vertical double arrows indicate, for a specific leakage profile 214, the fuel quantity (a) which is introduced into the fuel/air mixture by means of the injection valve leakage (lower double arrow), and (b) which is introduced into the fuel/air mixture by a desired injection (upper double arrow). For a leakage profile 216 with a relatively high leakage rate, a different ratio would result between the injection quantity of the injector and the leakage fuel quantity with a relatively high proportion of leakage fuel quantity. For a leakage profile 212 with a relatively low leakage rate, a different ratio would also arise between the injection quantity of the injector and the leakage fuel quantity with a relatively low proportion of leakage fuel quantity.

The text which follows describes an exemplary embodiment of a method for estimating a leakage fuel quantity which penetrates an intake section or a cylinder of an internal combustion engine of a motor vehicle from a leaking injection valve during a shut-down time of the motor vehicle, and during a starting process is added to a fuel mixture to be burnt. In this context, it is assumed that the leakage is different for each individual injection valve in an engine. However, owing to the shut-down times which have the tendency to be long, it is observed that vaporous fuel is distributed uniformly in the intake manifold and that as a result the enrichment owing to the injection valve leakage acts uniformly on all the cylinders of the engine.

According to the exemplary embodiment illustrated here, the method has two steps. A first step (A) is the basic detection of leakage. A second step (B) is the calculation or estimation of the leakage fuel quantity or of an adaptation value for compensating the leakage fuel quantity.

(A) Method for Basically Detecting an Injection Valve Leakage:

According to the exemplary embodiment illustrated here, an injection valve leakage is inferred if, in the case of starting of the internal combustion engine, the following two features (1) and (2) occur: (1) The internal combustion engine does not go above the starting rotational speed of the starter directly after activation of the starter. (2) The internal combustion engine then starts with a delay after a defined air mass is sucked out of the intake manifold (as a function of the engine swept volume and the intake manifold volume), and goes above the starter rotational speed until a predefined idling rotational speed is reached.

If the features (1) and (2) are observed, according to the exemplary embodiment illustrated here, enrichment of the fuel/air mixture which is caused by an injection valve leakage is then inferred. The injected fuel quantity can then be reduced when starting occurs next, with the result that a mixture which can be ignited with a lambda value in the range between 0.8 and 1.3 is then still present in all cases.

It is to be noted that the injection valve leakage can also be determined alternatively or in combination by means of a known algorithm for fuel quality adaptation. In this context, the ignition capability and/or the volatility of the fuel is typically determined based on the motor effect of the fuel or of the fuel/air mixture.

For example, the fuel quality adaptation can be carried out during short shut-down times of the operationally warm engine, and the factor for the volatility of the fuel can therefore be determined. A leakage of an injection valve generally does not bring about any significant increase in the fuel quantity in the cylinder if the shut-down time is shorter than half an 1 hour. In the case of relatively long shut-down times (between hour and 8 hours), the same algorithm is applied. If the fuel quality algorithm then detects an excessively rich mixture, increased leakage of an injection valve must be present. The injection quantity is then correspondingly reduced at a subsequent starting process after a comparable shut-down time.

The fact that, in the case of a relatively long shut-down time of the engine, the coolant of the engine, and therefore the engine itself, cools down to a greater degree, as a result of which the fuel quantity which is necessary for a smooth starting process in the cylinder is increased, is apparent from FIG. 2 (cf. the upper line which runs, in a good approximation, straight and slightly obliquely).

It is to be noted that the fuel quality adaptation function in the engine controller can take into account the quality of the fuel with which the vehicle is currently being refueled.

Additional fuel enters the intake manifold or the cylinder as a result of an injection valve leakage. The injection valve leakage is typically dependent on the fuel temperature and the differential pressure at the sealing seat of the injection valve. During the first hours, the leakage fuel quantity rises approximately linearly until the fuel temperature has assumed the ambient temperature and the differential pressure at the sealing seat has been eliminated. As is apparent from FIG. 2, for optimum combustion with low emission values, the injection quantity which has to be injected by the injection valve or by the injection valves is reduced by the respective leakage fuel quantity.

(B) Calculation/Estimation of the Injection Valve Leakage:

According to the exemplary embodiment illustrated here, for the calculation of the fuel leakage quantity m—FuelLeak, a start index I which is characteristic of a starting behavior of the internal combustion engine is introduced. The start index I can be, for example, the ratio between an actual time period $T_{StartAct}$ for the respective starting process and a predetermined setpoint time period $T_{StartSetp}$ for the respective starting process. Alternatively, the start index can also be a function of the ratio between an actual rotational speed gradient for the respective starting process and a predetermined setpoint rotational speed gradient for the respective starting process.

Figure 3:
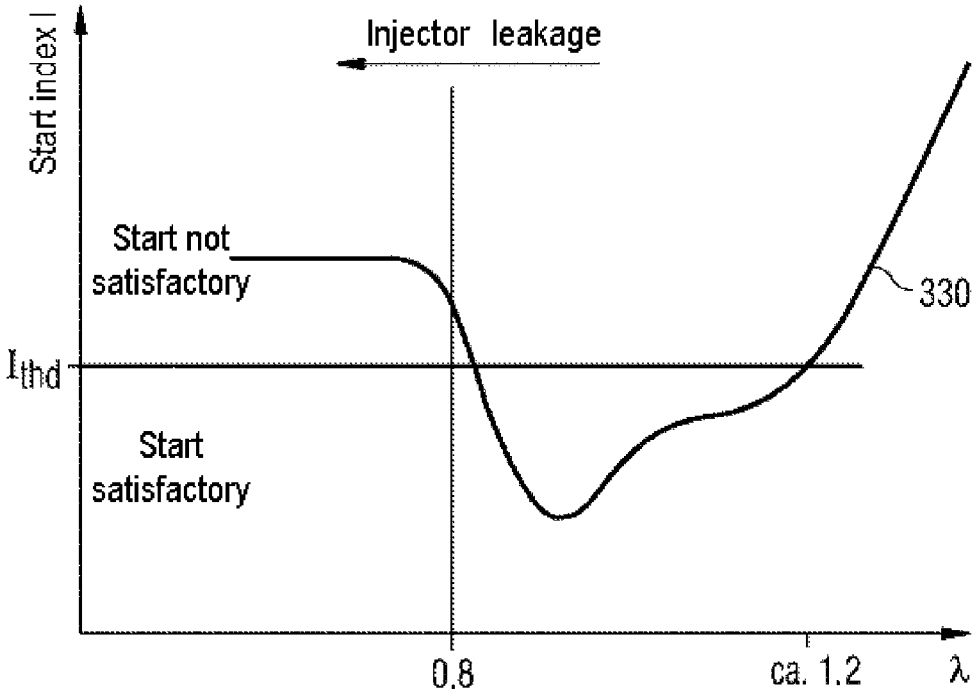
FIG. 3 shows the profile of a start index, characteristic of the starting behavior of an internal combustion engine, as a function of the lambda value of the fed-in fuel/air mixture.

FIG. 3 shows a typical profile 330 of a start index, which is characteristic of the starting behavior of an internal combustion engine, as a function of the lambda value λ of the fed-in fuel/air mixture. If the start index I is above a threshold value $I_{thd}$, then the starting of the internal combustion engine is defined as being not satisfactory. If the start index I is below the threshold value $I_{thd}$, then the starting of the internal combustion engine is defined as satisfactory. The horizontal arrow in FIG. 3 shows the influence of an injection valve leakage which, as already explained above, makes the fuel/air mixture richer for a starting process, with the result that the lambda value becomes smaller.

According to the exemplary embodiment illustrated here, a base value for the fuel leakage quantity $m_{FuelLeak}$ is described using the following equation system, wherein the equation (1) relates to a first starting process of the internal combustion engine, and the equation (2) relates to a second starting process of the internal combustion engine. However, it is to be noted that in principle higher-order equation systems, which have, for example, second-order polynomials, can also be used.

$$I_1=F\cdot m_{Fuel1}+F\cdot m_{FuelLeak}+I_0 \quad (1)$$

$$I_2=F\cdot m_{Fuel2}+F\cdot m_{FuelLeak}+I_0 \quad (2)$$

where $I_1$ is the start index for the first starting process, $I_2$ is the start index for the second starting process, $m_{Fuel1}$ is a fuel quantity which is injected during the first starting process, $m_{Fuel2}$ is a fuel quantity which is injected during the second starting process, F is a proportionality factor which describes the gradient of the respective straight line (the same for both starting processes), and $I_0$ is an offset value (the same for both starting processes).

In order to solve this equation system, the values for $I_1$ and $I_2$ are measured. In addition, it is assumed that the values for $m_{Fuel1}$ and $m_{Fuel2}$ are known, for example, from the respective electrical actuation characteristic and the rail pressure. The value for $I_0$ or the value for F is obtained from a previously known characteristic diagram. As a result, the two remaining unknowns $m_{FuelLeak}$ and F or $I_0$ can be determined. In this context, depending on the accuracy and computing time requirements, either analytical or regression methods can be used.

It is to be noted that the equation system described above merely constitutes the basic principle of the method for estimating the leakage fuel quantity. For use in an engine controller, it is also possible to take into account a modeling of the influence of operating parameters such as, for example, engine temperature and ambient temperature as well as engine swept volume and intake manifold volume for the correction of the injection quantities which are taken into account finally. This means that the base leakage quantity which is obtained from the solution of the abovementioned equation system as a function of operating parameters such as the temperature of the injection valve and the shut-down time then still has to be converted as a function of the ambient conditions of the operating points of the adaptation to a further application range by means of a model.

In addition, the results of the leakage quantity adaptation can be logically combined with the results of the fuel quality adaptation and applied as a function of the operating point.

The proposed method makes it possible to operate injection valves with relatively high leakage values in a way which is optimized in terms of starting emissions and starting time. As a result, the service life of the injection valves can be prolonged under ambient conditions which are unfavorable for leakage and/or the yield during the injection valve production process can be increased.

LIST OF REFERENCE NUMBERS

100 Estimation device
102 Measuring device
104 Device for determining injected fuel quantities
106 Data-processing device
212 Leakage profile
214 Leakage profile
216 Leakage profile
330 Profile of start index I as a function of the lambda value

The invention claimed is:

1. A method for estimating a leakage fuel quantity which penetrates an intake section or a cylinder of an internal combustion engine of a motor vehicle from a leaking injection valve during a shut-down time of the motor vehicle, and during a starting process is added to a fuel mixture to be burnt, the method comprising:

measuring a first start index characteristic of a starting behavior of the internal combustion engine during a first starting process, determining a first injected fuel quantity during the first starting process, measuring a second start index characteristic of a starting behavior of the internal combustion engine during a second starting process, determining a second injected fuel quantity during the second starting process, and estimating the leakage fuel quantity based on the measured first start index, the determined first injected fuel quantity, the measured second start index, and the determined second injected fuel quantity.

2. The method of claim 1, wherein the estimation of the leakage fuel quantity comprises:

setting up an equation system with at least two equations, wherein:

a first equation relates to the first starting process and is selected such that it shows a linear relationship between the first start index and the leakage fuel quantity to be estimated, and a second equation relates to the second starting process and is selected such that it shows a linear relationship between the second start index and the leakage fuel quantity to be estimated, a proportionality factor in the first and second equations has the same value, and a constant in the first and second equations has the same value, and solving the equation system, wherein at least one of the proportionality factor and the constant is determined from a previously known characteristic diagram of an engine controller for the internal combustion engine.

3. The method of claim 2, wherein:

at least one nominal basic profile of the leakage fuel quantity is stored in the characteristic diagram of the engine controller as a function of the shut-down time of the motor vehicle, and the nominal basic profile is taken into account in the estimation of the leakage fuel quantity.

4. The method of claim 2, wherein:

the first equation also shows a higher-order relationship between the first start index and the leakage fuel quantity to be estimated, and the second equation also shows a higher-order relationship between the second start index and the leakage fuel quantity to be estimated.

5. The method of claim 1, wherein:

wherein the respective start index is a function of the ratio between an actual time period for the respective starting process and a predetermined setpoint time period for the respective starting process, or wherein the respective start index is a function of the ratio between an actual rotational speed gradient for the respective starting process and a predetermined setpoint rotational speed gradient for the respective starting process.

6. The method of claim 1, wherein:

the method is performed for various operating conditions or ambient conditions of the motor vehicle, and the corresponding values for the leakage fuel quantity are stored, together with parameters which describe the various operating conditions or ambient conditions, in a characteristic diagram within a memory of an engine controller for the internal combustion engine.

7. The method of claim 1, further comprising determining whether a leakage fuel quantity from a leaking injection valve is present, and performing the method for estimating the leakage fuel quantity in response to determining that the leakage fuel quantity exceeds a predetermined leakage threshold value.

8. A method for determining a fuel quantity which is to be injected by means of a leaking injection valve in the course of a starting process of an internal combustion engine of a motor vehicle, the method comprising:

determining a total fuel quantity for optimum starting of the internal combustion engine, estimating a leakage fuel quantity by:

measuring a first start index characteristic of a starting behavior of the internal combustion engine during a first starting process, determining a first injected fuel quantity during the first starting process, measuring a second start index characteristic of a starting behavior of the internal combustion engine during a second starting process, determining a second injected fuel quantity during the second starting process, and estimating the leakage fuel quantity based on the measured first start index, the determined first injected fuel quantity, the measured second start index, and the determined second injected fuel quantity, and determining the fuel quantity to be injected from the difference between the total fuel quantity and the estimated leakage fuel quantity.

9. The method of claim 1, further comprising:

calculating the proportion of the total fuel quantity constituted by the leakage fuel quantity, and if the calculated proportion exceeds a predefined threshold value, cleaning the injection valve.

10. A device for estimating a leakage fuel quantity which penetrates an intake section or a cylinder of an internal combustion engine of a motor vehicle from a leaking injection valve during a shut-down time of the motor vehicle, and during a starting process is added to a fuel mixture to be burnt, the device comprising:

a measuring device configured to measure a first start index characteristic of a starting behavior of the internal combustion engine during a first starting process, and to measure a second start index characteristic of a starting behavior of the internal combustion engine during a second starting process, a device configured to determine a first injected fuel quantity during the first starting process and to determine a second injected fuel quantity during the second starting process, and a data-processing device configured to estimate the leakage fuel quantity based on the measured first start index, the determined first injected fuel quantity, the measured second start index and the determined second injected fuel quantity.

11. The device of claim 10, wherein the estimation of the leakage fuel quantity by data-processing device comprises:

setting up an equation system with at least two equations, wherein:

a first equation relates to the first starting process and is selected such that it shows a linear relationship between the first start index and the leakage fuel quantity to be estimated, and a second equation relates to the second starting process and is selected such that it shows a linear relationship between the second start index and the leakage fuel quantity to be estimated, a proportionality factor in the first and second equations has the same value, and a constant in the first and second equations has the same value, and solving the equation system, wherein at least one of the proportionality factor and the constant is determined from a previously known characteristic diagram of an engine controller for the internal combustion engine.

12. The device of claim 11, wherein:

at least one nominal basic profile of the leakage fuel quantity is stored in the characteristic diagram of the engine controller as a function of the shut-down time of the motor vehicle, and the nominal basic profile is taken into account in the estimation of the leakage fuel quantity.

13. The device of claim 11, wherein:

the first equation also shows a higher-order relationship between the first start index and the leakage fuel quantity to be estimated, and the second equation also shows a higher-order relationship between the second start index and the leakage fuel quantity to be estimated.

14. The device of claim 10, wherein:

the respective start index is a function of the ratio between an actual time period for the respective starting process and a predetermined setpoint time period for the respective starting process, or the respective start index is a function of the ratio between an actual rotational speed gradient for the respective starting process and a predetermined setpoint rotational speed gradient for the respective starting process.

15. The device of claim 10, wherein:

the data-processing device is configured to estimate the leakage fuel quantity for various operating conditions or ambient conditions of the motor vehicle, and the corresponding values for the leakage fuel quantity are stored, together with parameters which describe the various operating conditions or ambient conditions, in a characteristic diagram within a memory of an engine controller for the internal combustion engine.

16. The device of claim 10, wherein the data-processing device is configured to determine whether a leakage fuel quantity from a leaking injection valve is present, and estimate the leakage fuel quantity in response to determining that the leakage fuel quantity exceeds a predetermined leakage threshold value.

* * * * *